US008007006B2

(12) United States Patent
Damiano

(10) Patent No.: US 8,007,006 B2
(45) Date of Patent: Aug. 30, 2011

(54) ANTI-CORROSION SKATE GUARD

(75) Inventor: Frank Damiano, Woodbridge (CA)

(73) Assignee: Sports Technology Innovations Inc., Woodbridge, Ontario (CA)

( * ) Notice: Subject to any disclaimer, the term of this patent is extended or adjusted under 35 U.S.C. 154(b) by 0 days.

(21) Appl. No.: 12/500,717

(22) Filed: Jul. 10, 2009

(65) Prior Publication Data

US 2010/0045016 A1 Feb. 25, 2010

Related U.S. Application Data

(63) Continuation of application No. PCT/CA2008/000035, filed on Jan. 10, 2008.

(60) Provisional application No. 60/884,289, filed on Jan. 10, 2007.

(51) Int. Cl.
*A63C 3/12* (2006.01)

(52) U.S. Cl. ..... 280/825; 280/811

(58) Field of Classification Search ..... 280/825, 280/811

See application file for complete search history.

(56) References Cited

U.S. PATENT DOCUMENTS

| | | | | |
|---|---|---|---|---|
| 2,395,394 | A * | 2/1946 | Carlson | 280/825 |
| 4,546,999 | A * | 10/1985 | Lehr | 280/825 |
| 5,848,808 | A * | 12/1998 | Fenton | 280/825 |
| 6,666,479 | B1 * | 12/2003 | Maddaleni | 280/825 |
| 2007/0228599 | A1 * | 10/2007 | Elkouh et al. | 264/173.11 |

* cited by examiner

*Primary Examiner* — Jeffrey J Restifo
*Assistant Examiner* — Erez Gurari
(74) *Attorney, Agent, or Firm* — Weingarten, Schurgin, Gagnebin & Lebovici LLP

(57) ABSTRACT

The present invention provides a skate guard for receiving a blade of an ice skate, the skate guard comprising a pouch and a corrosion inhibitor.

20 Claims, 3 Drawing Sheets

ANTI-CORROSION SKATE GUARD

FIELD OF INVENTION

The present invention relates to ice skate guards, and more particularly, ice skate guards for preventing skate blade corrosion.

BACKGROUND

Ice skate blade guards are typically made of stiff hard rubber with a means to attach it over a blade of an ice skate. The guards are used to protect the blade of the skate from damage as the skater walks over the ground to the ice skating area. They are also used to protect the skater from injury when transporting the skates and to prevent damage to the blades. Rubber guards allow water to accumulate in the blade track, which causes the blade to rust, discolor or become dull. Also, the dimensions of the rubber guards limits their use for covering different blade sizes, requiring a skater to purchase various guards for each size skate. This is a problem particularly for children who rapidly outgrow their skates.

Another type of ice skate blade cover is a bag-like cover which is soft and which has an elastic member completely enclosed in a hem extending about an opening in the bag. In use, the bag is stretched over the blade to cover it. Such blade covers are widely used by skaters who skate on indoor rinks and do not typically walk on the ground, rather they remove the bag cover immediately prior to use and do so, adjacent the ice. For example, U.S. Pat. No. 2,323,049 discloses a skate guard comprising a flat, flexible elastic strip of heavy elastic webbing and having pockets at each end for accepting the point and heal of a skate blade. The pockets are preferably formed of leather.

However, many skaters often do walk, even for a small distance, on their covered skate blades to the ice. The bag covers often cut through by the sharp blade edges and becomes damaged. To overcome this problem, bag-style covers may include reinforcing materials. For example, U.S. Pat. No. 4,546,999 discloses an ice skate guard comprising a pouch for receiving the blade of an ice skate for protecting a skater from sharp skate blades and for easy, foldable, pocket storage. The pouch comprises: an inner wall of fabric, an outer wall of fabric and a cushioning material disposed between the inner and outer walls. Hook and loop fasteners attached to the inner wall are used to secure the pouch to the skate blade. The inner fabric wall is preferably made of a cotton army duck material and the outer fabric wall is preferably made of a net-type material.

Bag covers also suffer the problem retaining moisture and promoting rusting of the skate blade. To reduce this problem, bag covers may be made using materials with wicking properties. For example, U.S. Pat. No. 6,666,479 discloses an ice skate guard comprising a pouch for receiving the blade of an ice skate. The pouch is constructed from multiple layers: an inner portion of moisture absorbent material, an outer portion of flexible material and a friction enhancing material disposed on the outer portion along a bottom of the pouch. The friction enhancing material is preferably a soft rubber. The outer portion of flexible material is fabricated from a material chosen from fleece, wool, flannel, nylon, denim, mesh fabric and cotton. U.S. Pat. No. 6,666,479 discloses that the inner portion of moisture absorbent material is fabricated from a material having wicking properties such as terry cloth, sponge, cotton and flannel, so that moisture from the blade is absorbed and directed away from the blade keeping it dry.

However, in use, the wicking properties of such moisture absorbent materials do not effectively draw moisture away from the skate blade and often have the opposite effect of keeping moisture in proximity of the skate blade, thus encouraging rust.

SUMMARY OF INVENTION

The present invention provides an improved skate guard for protecting skate blades from corrosion.

In an aspect, provided is a skate guard for receiving a blade of an ice skate, the skate guard comprising a pouch and a corrosion inhibitor, said pouch comprising a top opening for receiving the blade of the ice skate.

In an embodiment, the pouch comprises a first end and a second end, each end being closed.

In an embodiment, the pouch is adjustable and further comprises a resilient member for adjustably fitting the pouch about the blade of the ice skate.

In an embodiment, the pouch further comprises an inner layer comprising a moisture wicking material.

In an embodiment, the pouch further comprises an outer layer of wear resistant material.

In an embodiment, the pouch further comprises a friction enhancing material disposed on a portion the outer layer along the bottom of the pouch.

In an embodiment, the friction enhancing material extends from the one end to the second end.

In an embodiment, the friction enhancing material is rubber.

In an embodiment, the pouch further comprises a cushion disposed along the length of the bottom of the pouch and contained between the inner layer and the outer layer.

In an embodiment, the cushion has a longitudinal channel defined therein, the longitudinal channel sized and configured to receive a lower edge portion of the blade of the ice skate.

In an embodiment, the cushion comprises molded foam.

In an embodiment, the inner layer comprises a flexible bottom wall portion and two opposed flexible side wall portions joined to an opposed edge of the flexible bottom wall portion.

In an embodiment, the side wall portions are comprised of the moisture wicking material.

In an embodiment, the moisture wicking material comprises polyester, cotton, or wool.

In an embodiment, the moisture wicking material is a woven fabric or a non-woven fabric.

In an embodiment, the moisture wicking material is a fleece or a terry cloth.

In an embodiment, the bottom wall portion comprises a water-resistant material.

In an embodiment, the water-resistant material comprises polyester or nylon.

In an embodiment, the corrosion inhibitor is a vapour phase corrosion inhibitor.

In an embodiment, the vapour phase corrosion inhibitor is a silicone based vapour phase corrosion inhibitor.

In an embodiment, one or more of at least a portion of: the inner layer, the outer layer, or the cushion, is coated or impregnated with the corrosion inhibitor.

In an embodiment, a portion of the inner layer is coated or impregnated with the corrosion inhibitor.

In an embodiment, one or more of the side wall portions or bottom wall portion are coated or impregnated with the corrosion inhibitor.

In an embodiment, the outer layer comprises a wear resistant material comprising polyester or nylon.

In an embodiment, the resilient member is disposed along the top opening and contained therebetween the inner layer and the outer layer.

In an embodiment, the top edge of the inner layer and/or outer layer is folded inwardly to define a channel for containing the resilient member.

In an embodiment, the resilient member is an elastic band.

In an embodiment, the resilient member is a drawstring.

BRIEF DESCRIPTION OF THE FIGURES

Preferred embodiments of the invention will now be described, by way of example, with reference to the accompanying drawings, in which.

Similar references are used in different figures to denote similar components.

DETAILED DESCRIPTION

The present invention provides an improved skate guard comprising a pouch and a corrosion inhibitor which is useful for protecting the blade of an ice skate during storage and in particular, protects the blade of the skate from rusting. The improved skate guard is also useful for protecting the blade from damage when a skater walks in the skates across a hard surface. The skate guard is adjustable to fit over a variety of blades of differing shapes and sizes. In some embodiments, the skate guard may comprise an adjustable pouch comprising a resilient member for adjustably fitting the pouch about the blade of the ice skate.

In further embodiments, the skate guard may comprise a multilayered pouch to provide the blade additional protection. The pouch may comprise an outer layer comprised of a wear resistant or water resistant material to improve the durability of the skate guard or to reduce exposure of the skate blade to moisture. The pouch may also comprise an inner layer comprising a moisture wicking material to draw away any moisture adhering to the skate blade. In further embodiments, the skate guard may include a cushion, such as a molded foam cushion, for providing additional protection for the skate blade especially in circumstances where the skate guard is worn and walked over hard surfaces. The cushion may define a longitudinal channel for receiving the blade and may be positioned between the inner and outer layers of multilayered embodiments of the skate guard. In some embodiments, the skate guard may include closed first and second ends to provide protection for the toe and heel portions of the blade. In further embodiments, the cushion may extend into the toe and heel portions of the skate guard to provide even further protection.

The entirety or a portion of the pouch comprising the skate guard may be treated or impregnated with the corrosion inhibitor. In some embodiments, the entirety or a portion of the inner layer of the skate guard, and in particular the moisture wicking material comprising the inner layer, may be treated or impregnated with the corrosion inhibitor. In other embodiments, the entirety or a portion of the cushion may be treated or impregnated with the corrosion inhibitor. In further embodiments, the entirety or a portion of the outer layer may be treated or impregnated with the corrosion inhibitor. In still further embodiments, one or more of at least a portion: of the inner layer, outer layer and the cushion may be treated or impregnated with corrosion inhibitor.

Figure 1:
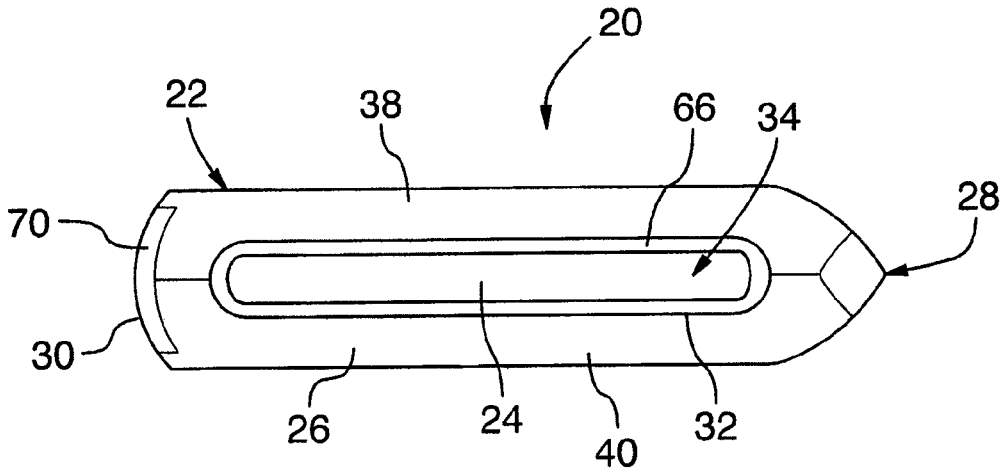
FIG. 1 is a top plan view of a skate guard.
Figure 4:
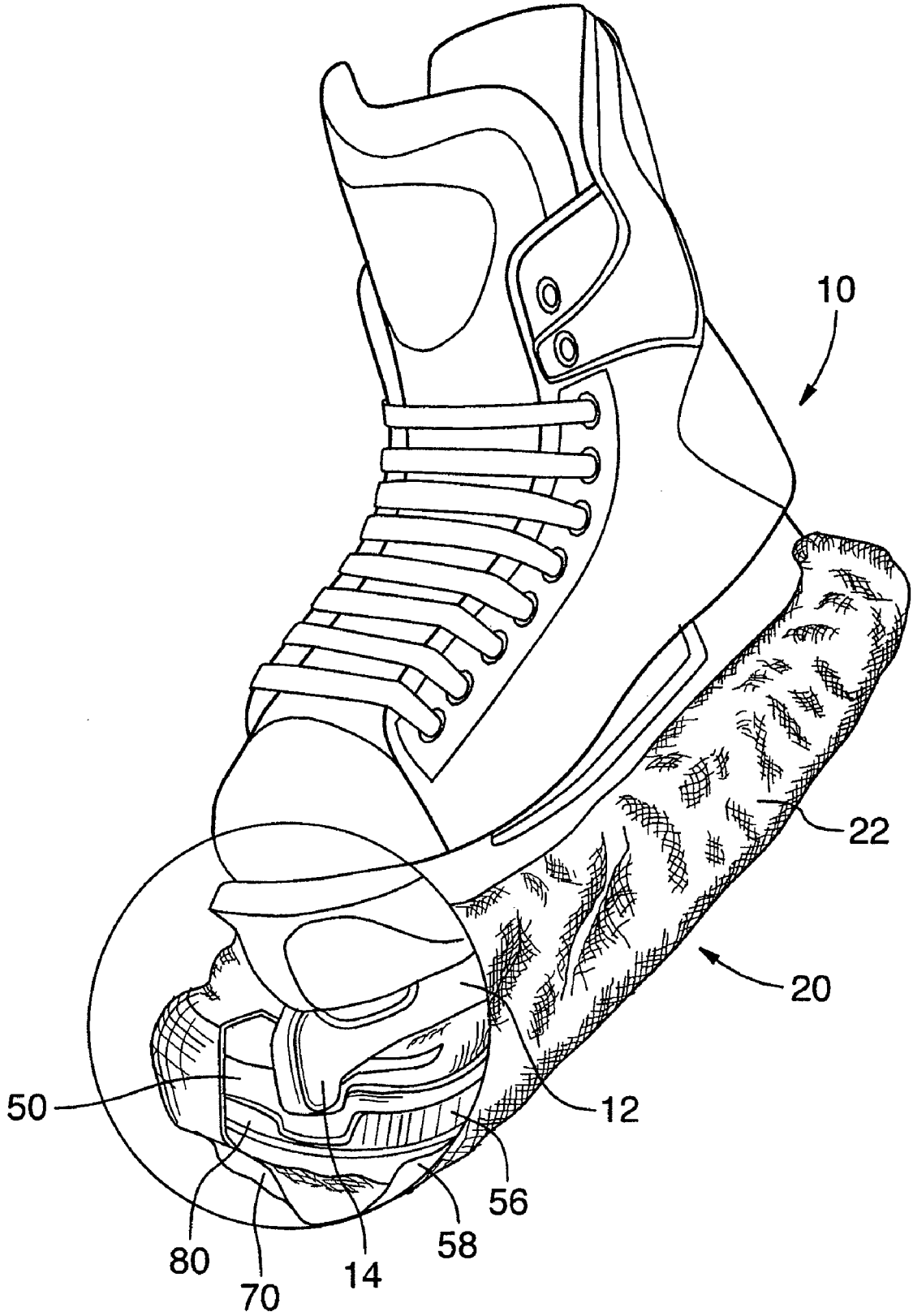
FIG. 4 is a perspective view of the skate guard attached to a skate, wherein the circled area is a partly broken away view of the skate guard.

As shown in FIGS. 1 and 4, in one embodiment of the invention, the skate guard 20 comprises an adjustable pouch 22 and a corrosion inhibitor, said pouch 22 comprising: a first end 28 and a second end 30, each said end 28, 30 being closed; a top opening 34 for receiving the blade 12 of the ice skate 10; an inner layer 24 comprising a moisture wicking material; an outer layer 26 of wear resistant material; and resilient member 66 for adjustably fitting said pouch 22 about the blade 12 of the ice skate 10.

As shown in FIG. 4, the pouch 22 is shaped and sized to cover at least a portion, and typically the entirety, of the blade 12 of the ice skate 10. The pouch 22 can be made of varying sizes to accommodate skate blades of different lengths, such as for example, women, men and child sizes. The size and shape of the pouch 22 can also be varied to cover blades of different styles of skates, such as for examples, figure skates, hockey skates or speed skates.

Figure 5:
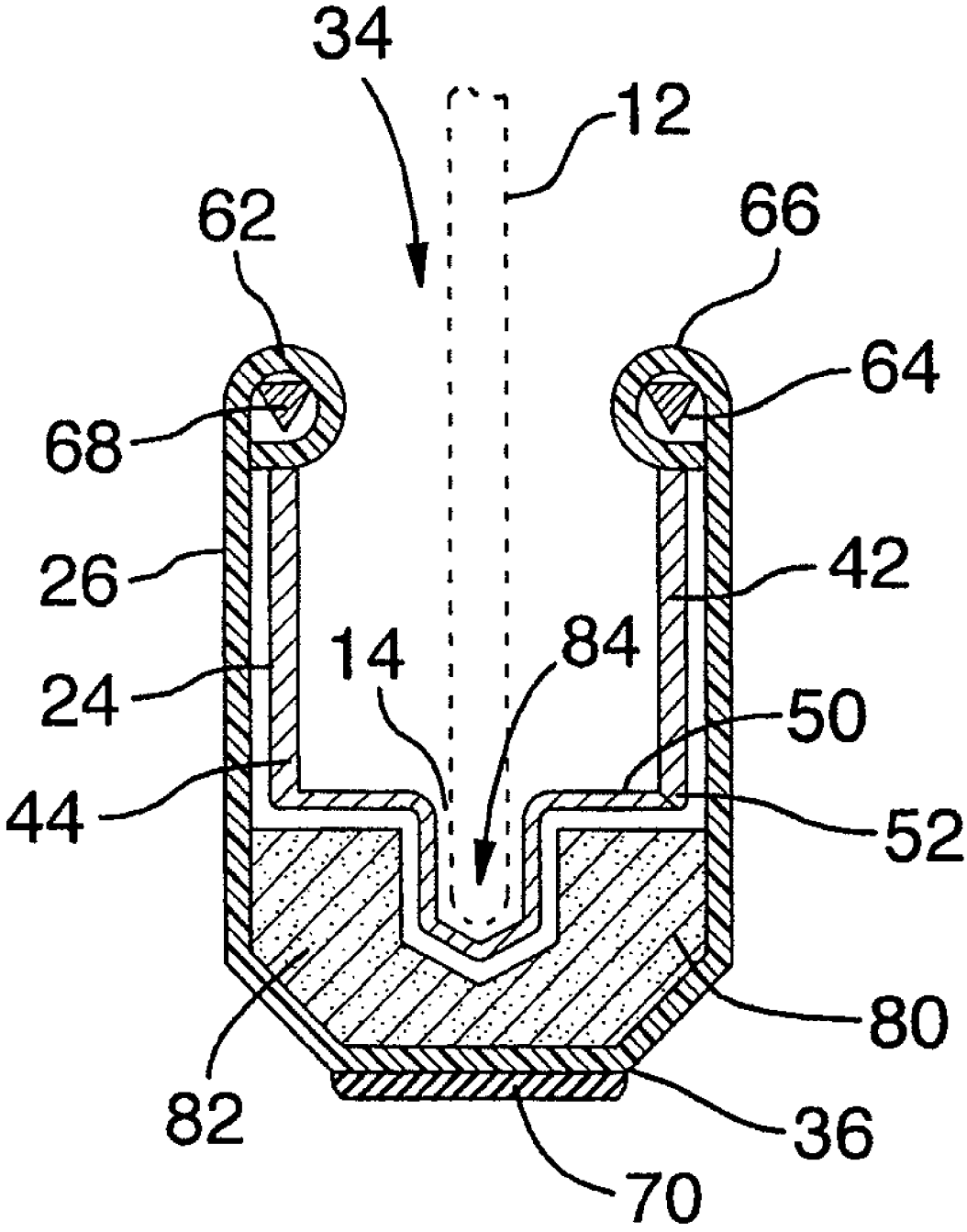
FIG. 5 is a cross-sectional view taken along line X-X' of FIG. 2.

As shown in FIG. 1, the pouch 22 comprises an outer layer 26 and inner layer 24 which are preferably sewn together to form the body of the pouch 22. The pouch 22 has opposed side portions 38, 40, closed first end 28 and second end 30, and a bottom portion 36. As shown in FIG. 5, the pouch 22 has a top opening 34 for receiving the blade 12 of the ice skate 10 (not shown). The pouch 22 includes resilient member 66 for adjustably fitting said pouch 22 about the blade 12 of the ice skate 10 (not shown). In preferred embodiments, resilient member 66 is disposed along the top opening 34 to allow the top opening 34 to expand and contract around the blade 12 of the ice skate 10.

Figure 3:
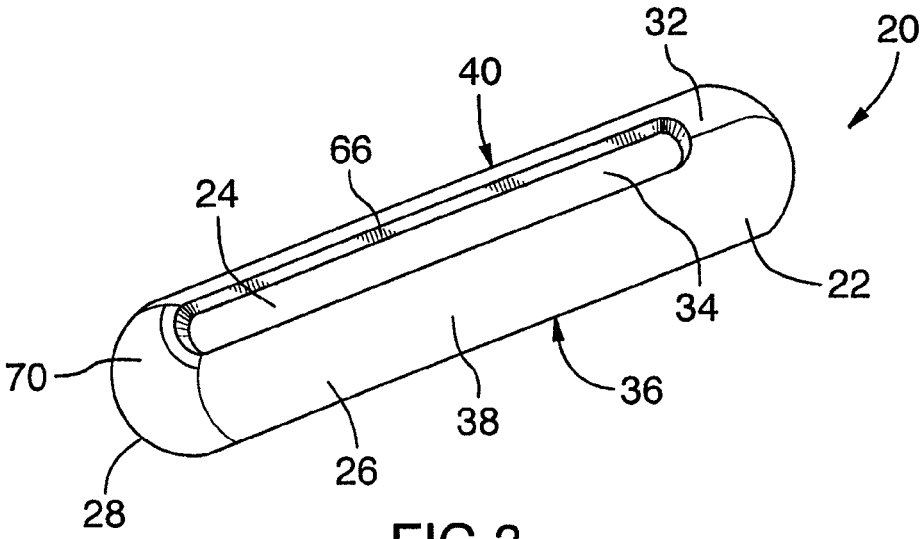
FIG. 3 is a perspective side view of the skate guard.

The outer layer 26 may be constructed from a material blank which is folded and sewn together to form the pouch 22. Alternatively, the outer layer 26 may be constructed using multiple sections of material which are sewn or otherwise joined together to form the side portions 38, 40, the closed first and second ends 28, 30, and the bottom portion 36 as shown in FIGS. 1 and 3.

The outer layer 26 is preferably comprised of a wear resistant material to protect the blade from damage, especially in circumstances where a skater will walk over hard surfaces with skate guard on over the blade. As used herein, "wear resistant" means any material which withstands damage due to exposure to chemical and/or mechanical forces experienced during ordinary use of the skate guard. In particular, the materials should be abrasion resistant and capable of withstanding abrasive forces encountered during ordinary handling and storage conditions. The wear resistant material is also preferably breathable to allow for the evaporation of any moisture trapped in the skate guard, especially moisture wicked by the inner layer 24.

In a further embodiment of the invention, the outer layer 26 may further comprise a water resistant material to protect the blade from moisture, such as circumstances where the skater will walk with the skate guard on in wet environments. As used herein "water resistant material" means any material which can withstand water infiltration during ordinary use of the skate guard. In preferred embodiments, the water resistant material is also breathable to allow evaporation of any moisture trapped in the skate guard; especially moisture wicked by the inner layer. For example, the water resistant material may comprise an outward facing surface which is resistant to water ingress while the inward facing surface of the material allows passage of water vapor.

The outer layer 26 may comprise a single layer of fabric which is wear resistant and optionally water resistant and breathable. Alternatively, the outer layer 26 may be constructed using a plurality of layers of one or more different types of fabric for enhanced wear resistance and/or water resistance. In some embodiments, the outer layer may comprise a first layer of a wear resistant material 58 and a second layer of a water resistant material 56 as shown in FIG. 4.

The wear and water resistant materials may be a woven or non-woven fabric comprising synthetic or natural fibers. In the case of woven fabrics, they may be tightly woven to impart wear and water resistance. The fabric may be chemically treated to impart water resistance using conventional treatment methods. In preferred embodiments, the wear resistant material comprises polyester or nylon fabric, and in particular polyester or nylon webbing. In further preferred embodiment, the fabric may include spandex fiber or other similar fibers to provide elasticity to the outer layer to allow greater ease of putting and taking the skate guard on and off a skate.

The inner layer 24 of the pouch 22 serves to line the interior of the pouch and functions to wick moisture from the blade. The inner layer 24 may be constructed from a single material blank. As shown in FIG. 5, the inner layer 24 may also be formed from sections of material which are sewn or otherwise joined together to form a pair of opposing side wall portions 42, 44 and a bottom wall portion 50 when assembled. The inner layer 24 is joined to the outer layer 26. In preferred embodiments, the inner layer 24 and outer layer 26 are stacked on one another and are sewn together along their respective outer edges (not shown) to form common seams (not shown).

In an embodiment, at least a portion of the inner layer 24 is constructed from a moisture wicking material. As used herein, "moisture wicking" means the ability of the material to draw moisture away from its surface and move the moisture to the interior of the material or to another material where the moisture can be evaporated.

The moisture wicking material may be a woven or non-woven fabric comprising synthetic or natural fibers. The moisture wicking material may be a fleece or a terry cloth. In preferred embodiments, the moisture wicking material may comprise polyester, cotton, or wool. In further preferred embodiments, the moisture wicking material may be a polyester fabric or polyester fleece. Any moisture on the blade is absorbed by the surface of the moisture wicking material and transported away from the blade. As the outer layer is constructed from a breathable material, the trapped moisture is removed from the skate guard by evaporation.

Different materials may be used to construct different portions of the inner layer. For example in one embodiment, the opposing side wall portions 42, 44 may be constructed from a polyester fleece to wick away moisture from the blade 12. The bottom portion 50 of the inner layer 24 may be constructed from a polyester fabric to reduce bulk, especially in embodiments which include a blade retaining cushion 80 (see further discussion below).

The skate guard 20 comprises a corrosion inhibitor. As used herein "corrosion inhibitor" and "rust inhibitor" are used interchangeably and refer to any additive or substance which prevents or reduces the oxidation of metal, in particular the oxidation of steel.

The entirety or a portion of the skate guard may be treated or impregnated with the corrosion inhibitor. In some embodiments, one or more of the inner layer 24, outer layer 26 or blade retaining cushion 80 (see further discussion below) may be treated or impregnated with the corrosion inhibitor. As used herein "treated" means the application of the corrosion inhibitor to at least one surface of the skate guard material by any conventional method including coating, spraying, and immersion. As used herein "impregnated" means the application of the corrosion inhibitor to the skate guard material by a method whereby the corrosion inhibitor is absorbed by the skate guard material.

In one embodiment, at least a portion of the inner layer 24 is treated or impregnated with a corrosion inhibitor One or more of the side wall portions 42, 46 and/or bottom portion 50 comprising the inner layer 24 may be treated or impregnated with the corrosion inhibitor. In some embodiments the blade retaining cushion 80 (see further discussion below) may also be treated or impregnated with the corrosion inhibitor. In other embodiments only the cushion 80 may be treated or impregnated with the corrosion inhibitor rather than the inner layer 24.

In circumstances wherein the moisture wicking capacity of the materials forming for the inner layer 24 is exceeded, the corrosion inhibitor will protect from the blade from rusting. In preferred embodiments, the corrosion inhibitor is a vapour phase corrosion inhibitor ("VCI"), also known as a volatile corrosion inhibitor. VCIs are widely commercially available. In use, VCI molecules vapourize and react with moisture on the skate blade to form an invisible film on the blade and protect the blade from corrosion. Examples of suitable vapour phase chemical corrosion inhibitors are known the art and commercially available. In one embodiment, the vapour phase corrosion inhibitor is a silicone based corrosion inhibitor.

As shown in FIG. 5, the skate guard 20 includes resilient member 66 for adjustably fitting said pouch 22 about the blade 12 of the ice skate 10. The resilient member 66 is typically disposed along the top opening 34 of the pouch 22 and allows for expansion of the circumference of the opening 34 for insertion of the blade 12 into the pouch 22 and contraction of the circumference of the opening 34 to secure the skate guard 20 around the blade 12. In one embodiment, the resilient member 66 is an elastic band 68 disposed along the top opening 34 and contained therebetween the inner layer 34 and said outer layer 36. A channel 64 for containing the elastic band 68 can be formed by sewing a portion of the inner layer 24 and outer layer together 26. Alternatively, a top portion 62 of the outer layer 26 may be folded inwardly and sewn down to form the channel 64 for receiving the elastic band 68. In another embodiment, the resilient member may comprise a drawstring (not shown) disposed along the top opening 34 and contained therebetween the inner layer 24 and said outer layer 26 and having exposed ends (not shown) to allow for adjustment of the skate guard 20. The skate guard 20 may include a channel 64 formed by inner layer 24 and/outer layer 26 and which includes an opening for the exposed ends of the drawstring as described above. In use, the drawstring is loosened to receive the blade and tightened to secure the skate guard around the blade. The drawstring may include a toggle lock or other locking means for securing the drawstring.

In a further embodiment, the skate guard 20 includes a blade retaining cushion 80 disposed along the length of the bottom portion 36 of said pouch 22 and contained between the inner layer 24 and the outer layer 26 as shown in FIGS. 4 and 5. The cushion 80 provides further protection for the blade 12 against damage, especially in circumstances where the skater walks over a hard surface. In a preferred embodiment, the cushion 80 has a longitudinal channel 84 defined therein, which is sized and configured to receive a lower edge portion of the blade of the ice skate. The channel 84 serves to securely retain the blade 12 within the skate guard 20, especially in circumstances where the skater is walking in the skates.

The cushion 80 may extend all the way to the one or more of the first and second ends 28, 30 of the skate guard to provide protection to the front or back tips of the skate blade. In preferred embodiments, at least the first end 28 (i.e. which in use would receive the toe end of the skate blade) of the skate guard 20 is padded with the cushion 80. This is particularly useful in the construction of skate guards for use with figure skates having toe picks.

In preferred embodiments the cushion 80 is made from molded foam. The cushion 80 may be treated or impregnated with a corrosion inhibitor, and more preferably a vapour phase corrosion inhibitor as described above. In some embodiments, both the cushion 80 and the inner layer 24 may be treated or impregnated with the corrosion inhibitor. In other embodiments, either the cushion 80 or the inner layer 24 may be treated or impregnated with the corrosion inhibitor.

Figure 2:
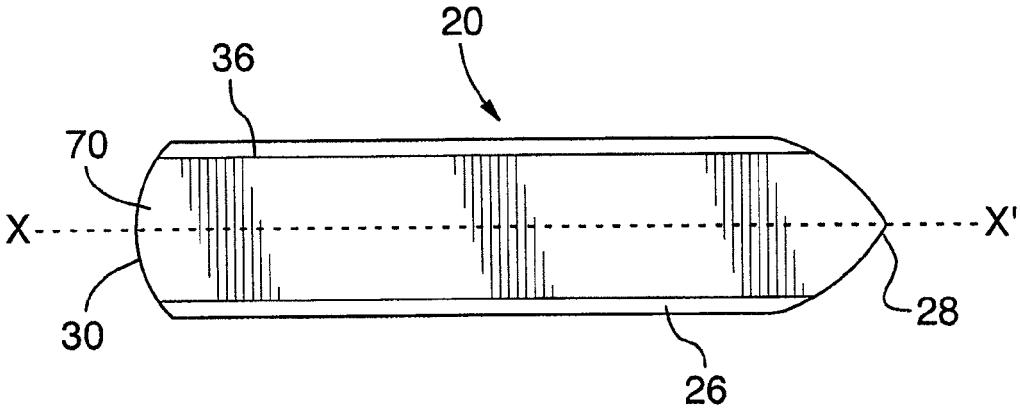
FIG. 2 is a bottom plan view of the skate guard.

In another embodiment of the invention, the skate guard 20 may include a friction enhancing material 70 disposed on a portion the outer layer 26 along the bottom 36 of the pouch 22. The friction enhancing material 70 reduces slippage and allows the skater to more easily and safely walk with the skate guard over slippery and/or wet surfaces. As shown in FIGS. 1 and 2, the friction enhancing material 70 preferably extends from the first end 28 (i.e. the toe end) to the second end 30 (i.e. the heel end). The friction enhancing material 70 is preferably a natural or synthetic rubber.

Although the invention has been described with reference to illustrative embodiments, it is to be understood that the invention is not limited to these precise embodiments, and that various changes and modification are to be intended to be encompassed in the appended claims.

I claim:

1. A skate guard for receiving a blade of a skate, the skate guard comprising an adjustable pouch, a first longitudinal channel and a second longitudinal channel defined therein, said pouch comprising a top opening for receiving the blade and a resilient member for adjustably fitting the pouch about the blade, wherein said first longitudinal channel is sized and configured to receive the blade, said second longitudinal channel being nested within the first longitudinal channel and being sized and configured to receive a lower edge portion of the blade, said longitudinal channels including walls configured to be parallel to sides of the blade when said blade is received.

2. The skate guard according to claim 1, wherein said pouch further comprises a flexible bottom wall portion and two opposed flexible side wall portions joined to an opposed edge of the flexible bottom wall portion.

3. The skate guard according to claim 2, wherein said longitudinal channels comprise molded foam.

4. The skate guard according to claim 1, said pouch comprising a first end and a second end, each end being closed.

5. The skate guard according to claim 1, wherein said pouch further comprises an inner layer comprising a moisture wicking material.

6. The skate guard according to claim 1, wherein said pouch further comprises an outer layer of wear resistant material.

7. The skate guard according to claim 6, wherein said pouch further comprises a friction enhancing material disposed on a portion the outer layer along the bottom of the pouch.

8. The skate guard according to claim 6, wherein the inner layer comprises a flexible bottom wall portion and two opposed flexible side wall portions joined to an opposed edge of the flexible bottom wall portion.

9. The skate guard according to claim 8, wherein the bottom wall portion comprises a water-resistant material.

10. The skate guard according to claim 1, wherein at least a portion of the pouch is coated or impregnated with a corrosion inhibitor.

11. The skate guard according to claim 10, wherein the corrosion inhibitor is a vapour phase corrosion inhibitor.

12. The skate guard according to claim 11, wherein the vapour phase corrosion inhibitor is a silicone based vapour phase corrosion inhibitor.

13. The skate guard according to claim 12, wherein one or more of: the inner layer, the outer layer, or the cushion, is coated or impregnated with the corrosion inhibitor.

14. The skate guard according to claim 13, wherein a portion of the inner layer is coated or impregnated with the corrosion inhibitor.

15. The skate guard according to claim 14, wherein one or more of the side wall portions or bottom wall portion are coated or impregnated with the corrosion inhibitor.

16. The skate guard according to claim 6, wherein the outer layer comprises a wear resistant material selected from a group consisting of: polyester and nylon.

17. The skate guard according to claim 1, wherein the resilient member is disposed along the top opening and contained therebetween the inner layer and the outer layer.

18. The skate guard according to claim 17, wherein the top edge of the inner layer and/or outer layer is folded inwardly to define a channel for containing the resilient member.

19. The skate guard according to claim 17, wherein the resilient member is an elastic band.

20. The skate guard according to claim 5, wherein said inner layer is configured to conform in spatial relation to said longitudinal channels.

* * * * *